US009407980B1

(12) United States Patent
Cheng

(10) Patent No.: US 9,407,980 B1
(45) Date of Patent: Aug. 2, 2016

(54) CLIP-ON TRANSCEIVER MICROPHONE

(71) Applicant: Liang-Chih Cheng, New Taipei (TW)

(72) Inventor: Liang-Chih Cheng, New Taipei (TW)

( * ) Notice: Subject to any disclaimer, the term of this patent is extended or adjusted under 35 U.S.C. 154(b) by 13 days.

(21) Appl. No.: 14/645,050

(22) Filed: Mar. 11, 2015

(51) Int. Cl.
*H04R 1/08* (2006.01)
*H04R 1/04* (2006.01)

(52) U.S. Cl.
CPC .. *H04R 1/08* (2013.01); *H04R 1/04* (2013.01); *A45F 2200/0508* (2013.01)

(58) Field of Classification Search
CPC ..... H04R 1/04; H04R 1/08; H04R 1/083; A45F 2200/0508; A45F 2200/0516; A45F 2005/027; A45F 2005/028; Y10T 24/1391; Y10T 24/1394; Y10T 24/44376
See application file for complete search history.

(56) References Cited

U.S. PATENT DOCUMENTS 1,932,581 A * 10/1933 Gilman ..... H04R 21/021 181/153
2,505,551 A * 4/1950 Knowles ..... H04R 25/04 381/319
4,100,653 A * 7/1978 Sensabaugh ..... H04M 1/05 224/669
5,806,146 A * 9/1998 Chen ..... H04R 1/08 24/3.1
5,850,613 A * 12/1998 Bullecks ..... H04B 1/385 200/332
6,149,043 A * 11/2000 Goto ..... G08B 3/1058 224/272
6,752,299 B2 * 6/2004 Shetler ..... A45F 5/02 224/197
6,757,401 B2 * 6/2004 Uchimura ..... H04R 1/08 248/309.1
7,752,716 B2 * 7/2010 Babasaki ..... A45F 5/02 224/197
8,175,314 B1 * 5/2012 Webster ..... H04R 1/028 381/122
2008/0237282 A1 * 10/2008 Sin ..... A45F 5/02 224/197
2008/0305840 A1 * 12/2008 Lin ..... A45F 5/02 455/575.1
2011/0062302 A1 * 3/2011 Choi ..... A45F 5/02 248/316.7
2014/0370855 A1 * 12/2014 Koss ..... H04M 3/53366 455/413
2015/0212544 A1 * 7/2015 Chen ..... G06F 1/1632 361/679.41

* cited by examiner

*Primary Examiner* — Matthew Eason
(74) *Attorney, Agent, or Firm* — Shimokaji IP

(57) ABSTRACT

A clip-on transceiver microphone includes a first body, a second body, and a pivot shaft assembly. The first body has a circuit board therein. The second body has a battery therein. The battery supplies power to the circuit board inside the first body through a power wire. The first body further has a microphone jack for connecting with an external microphone to receive voice. The first body is pivotally connected with the second body by the pivot shaft assembly. After being assembled, two clipping ends of the first body and the second body are tied to each other. Two squeezing ends of the first body and the second body are pushed to open the two clipping ends and then clip on clothes of a user, thereby attaching the clip-on transceiver microphone on the object of the user.

15 Claims, 9 Drawing Sheets

CLIP-ON TRANSCEIVER MICROPHONE

BACKGROUND OF THE INVENTION

1. Field of the Invention

The present invention relates to a transceiver microphone, and more particularly, to a compact and portable clip-on transceiver microphone.

2. Description of the Related Art

Owing to technological progress, electronic products all head for the trend of using wireless transmission in place of conventional wireline transmission. Since electronic products capable of conveniently searching information or sending e-mail through wireless networks penetrate into all aspects of daily life of modernized people, mobile devices, such as smart phones, tablet personal computers (PCs), and notebook computers have become more and more indispensable and greatly lessen the use of desktop PCs with wired connection to networks for communication. Likewise, a conventional wired speaker microphone also needs to be connected to a receiver, such as a speaker, through a cable to transmit the speaker's voice to the receiver for playing. Because of the physical cable, the user can only speak in a range limited by the cable and movement freedom is restricted to prevent the microphone connector from being disconnected.

One conventional way of wirelessly transmitting voice signals can be implemented by a wireless microphone and a receiving host. When speaking to the wireless microphone, user's voice can be wirelessly transmitted to the receiving host and played by a speaker connected to the receiving host.

Another conventional way of wirelessly transmitting voice signals can be implemented by an audio receiver and a wireless transceiver. The wireless transceiver has an audio receiver and a wireless transceiver. The wireless transceiver has a microphone jack connected to the audio receiver through a connection wire for the audio receiver to generate sound signals which are transmitted out by the wireless transceiver. Being sort of bulky, the wireless transceiver is oftentimes hung at a lower back of the user. Therefore, the connection wire that must be extended from the sound-uttering position to the audio receiver is rather long and causes operational inconvenience for being far from the sound-uttering position of the user.

SUMMARY OF THE INVENTION

An objective of the present invention is to provide a clip-on transceiver microphone with compact size and portability.

To achieve the foregoing objective, the clip-on transceiver microphone has a first body, a second body, and a pivot shaft assembly.

The first body has a circuit board, a microphone jack, a first shaft bracket, and a first force exertion portion.

The microphone jack is formed on the first body and is electrically connected to the circuit board.

The first shaft bracket is formed on an inner surface of the first body.

The first force exertion portion is located on a top portion of an outer surface of the first body opposite to a portion of the inner surface of the first body with the first shaft bracket.

The second body has a battery, a second shaft bracket, and a second force exertion portion.

The battery is mounted inside the second body with a power wire electrically connected to the circuit board in the first body to supply power to the circuit board.

The second shaft bracket is formed on an inner surface of the second body.

The second force exertion portion is located on a top portion of an outer surface of the second body opposite to a portion of the inner surface of the second body with the second shaft bracket.

The pivot shaft assembly is pivotally mounted through the first shaft bracket and the second shaft bracket with a bottom portion of the inner surface of the first body abutting against a bottom portion of the inner surface of the second body after the pivot shaft assembly is assembled with the first body and the second body.

Given the foregoing clip-on transceiver microphone, the circuit board is mounted inside the first body, and the battery is received inside the second body with the circuit board electrically connected to the battery. Therefore, the size of the transceiver microphone is significantly reduced. The first body and the second body are pivotally connected with the pivot shaft assembly mounted between the first body and the second body to form a clipping structure. Accordingly, after force is applied on the first and second force exertion portions, the clip-on transceiver microphone can be clipped on an object of a user and carried around with the user.

Other objectives, advantages and novel features of the invention will become more apparent from the following detailed description when taken in conjunction with the accompanying drawings.

DETAILED DESCRIPTION OF THE INVENTION

Figure 1:
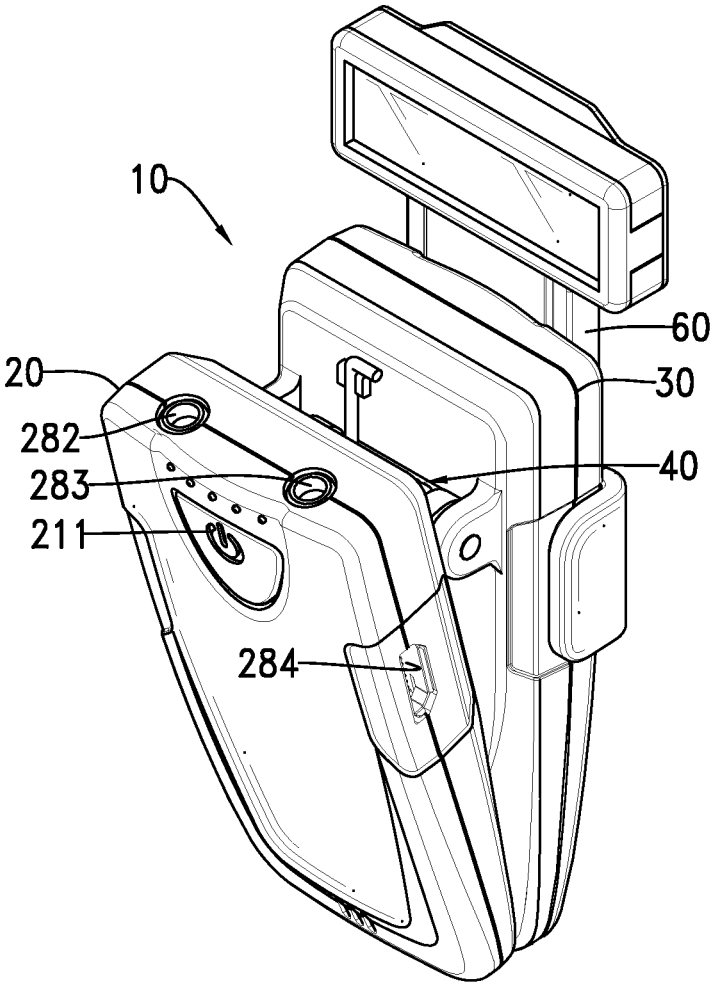
FIG. 1 is a perspective view of a first embodiment of a clip-on transceiver microphone in accordance with the present invention.
Figure 2:
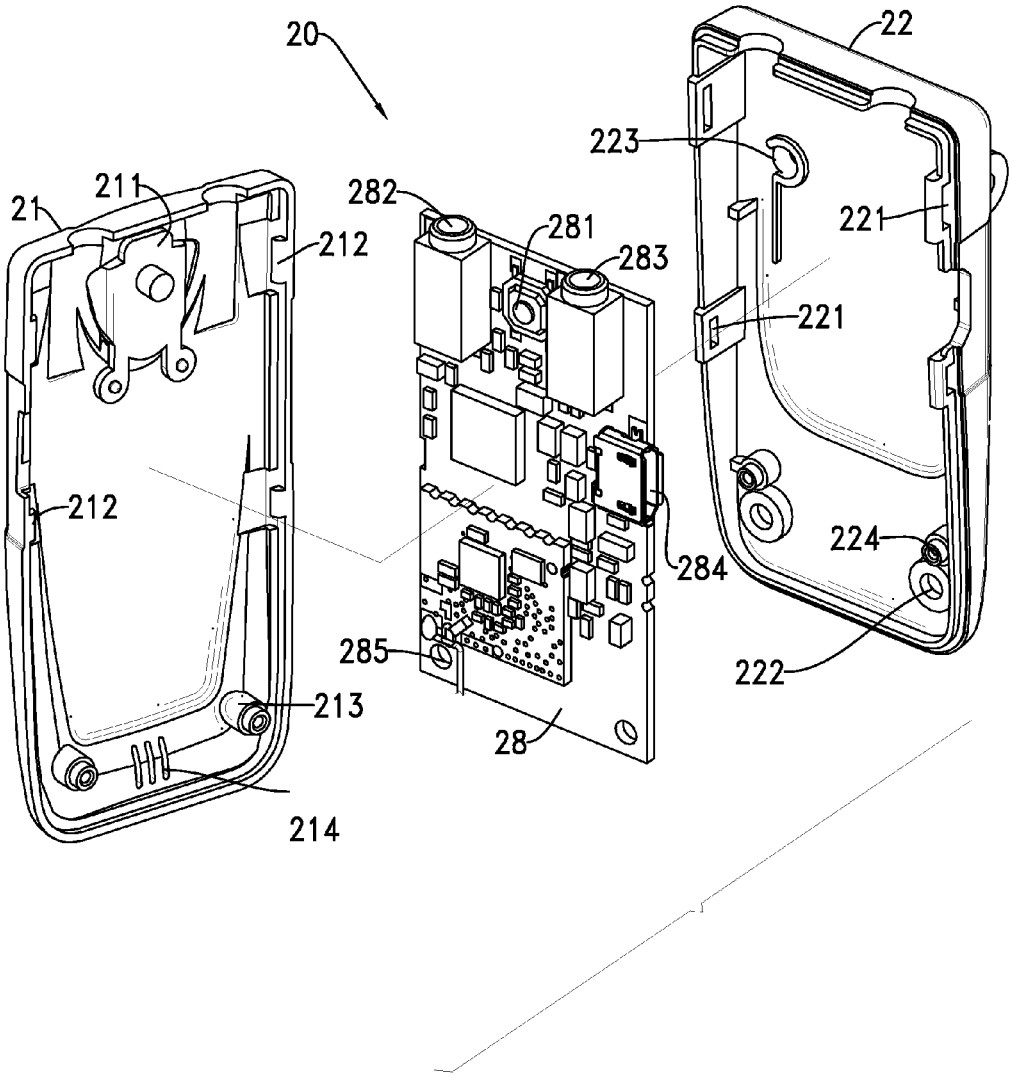
FIG. 2 is an exploded perspective view of a first body of the clip-on transceiver microphone in FIG. 1.

With reference to FIG. 1, a first embodiment of a clip-on transceiver microphone 10 in accordance with the present invention includes a first body 20, a second body 30, and a pivot shaft assembly 40. The first body 20 faces the second body 30 and is pivotally connected with the second body 30 through the pivot shaft assembly 40.

The first body 20 has an audio input jack 282, a microphone jack 283, a USB (Universal Serial Bus) port 284, a first front lid 21, a first rear lid 22, a circuit board 28, and a trigger button 211. The audio input jack 282 and the microphone jack 283 are formed on a top edge of the first body 20. The microphone jack 283 is formed on one of two lateral edges of the first body 20 and can be connected to an external power source through a USB cable for the external power source to charge the clip-on transceiver microphone. The first front lid 21 has at least one projection 212 and at least one first pin 213. The at least one projection 212 is formed around and protrudes inwards from an inner perimetric edge of the first front lid 21. The at least one first pin 213 is formed on and protrudes inwards from a lower portion of an inner surface of the first front lid 21. The first rear lid 22 has at least one opening 221, at least one first pin hole 222, and at least one second pin 224. The at least one opening 221 is formed through two lateral edges of the first rear lid 22. The at least one first pin hole 222 is formed in a lower portion of an inner surface of the first rear lid 22. The at least one second pin 224 is formed on and protrudes inwards from the inner surface of the first rear lid 22. When the first front lid 21 joins the first rear lid 22, the at least one projection 212 of the first front lid 21 engages the at least one opening 221 of the first rear lid 22 and the at least one first pin 213 of the first front lid 21 is inserted into the at least one first pin hole 222 of the first rear lid 22, such that the first front lid 21 can be assembled on the first rear lid 22.

The circuit board 28 is mounted inside the first body 20, and has a power switch 281 and at least one second pin hole 285. The power switch 281, the audio input jack 282, the microphone jack 283, and the USB port 284 are formed on the circuit board 28. The at least one second pin 224 of the first rear lid 22 is inserted into the at least one second pin hole 285 of the circuit board 28 for the circuit board 28 to be fastened on the first rear lid 22. The audio input jack 282 and the microphone jack 283 are mounted on a portion of a surface of the circuit board 28 adjacent to a top edge of the circuit board 28. The USB port 284 is mounted on a portion of the surface of the circuit board 28 adjacent to one of two lateral edges of the circuit board 28. The power switch 281 is mounted on a portion of the surface of the circuit board 28 adjacent to the top edge of the circuit board 28. The trigger button 211 is formed on the inner surface of the first front lid 21 to correspond to the power switch 281 of the circuit board 28. When pressed, the trigger button 211 abuts against the power switch 281 to activate the circuit board 28, such that the functions of the clip-on transceiver microphone for receiving and transmitting audio signals can be started. After users can send a voice to the clip-on transceiver microphone 10 through a microphone plugged in the microphone jack 283, the clip-on transceiver microphone 10 further wirelessly transmits voice signals to an audio receiver to utter the voice. The audio input jack 282 serves to be connected to audio equipment, such as an MP3 player through a wire. Audio signals produced by the audio equipment are inputted to the clip-on transceiver microphone 10 through the audio input jack 282 and are wirelessly transmitted to an audio receiver. The first front lid 21 further has multiple sound-receiving holes 214 formed through a bottom portion of the first font lid 21. The circuit board 28 further has a microphone mounted thereon to receive sound through the multiple sound-receiving holes 214. The first rear lid 22 further has a first wire hole 223 formed through the first rear lid 22.

Figure 3:
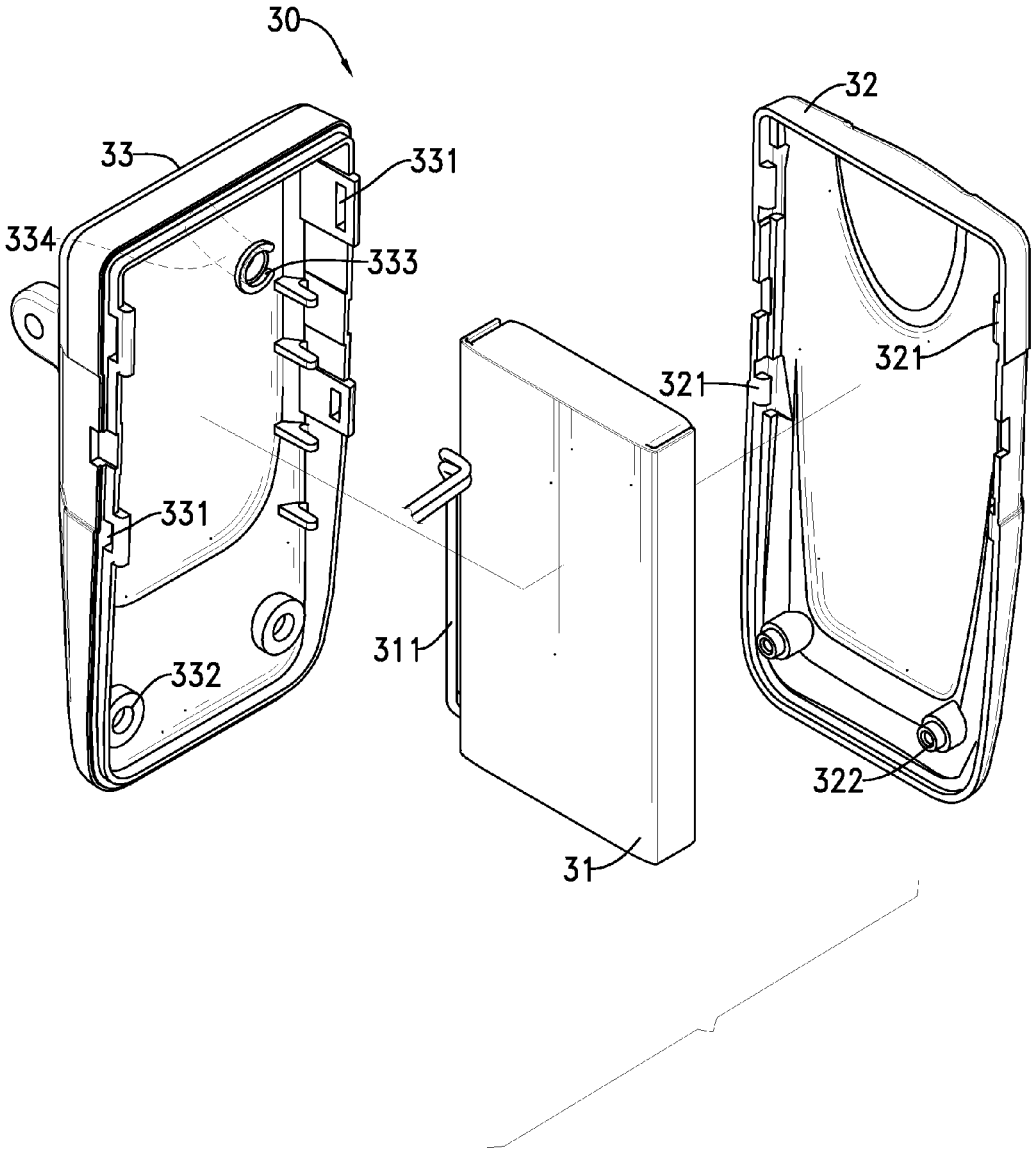
FIG. 3 is an exploded perspective view of a second body of the clip-on transceiver microphone in FIG. 1.

With reference to FIG. 3, the second body 30 has a second front lid 32, a second rear lid 33, and a battery 31. The second front lid 32 has at least one projection 321 and at least one third pin 322. The at least one projection 321 is formed around and protrudes inwards from an inner perimetric edge of the second front lid 32. The at least one third pin 322 is formed on and protrudes inwards from a lower portion of an inner surface of the second front lid 32. The second rear lid 33 has at least one opening 331, at least one third pin hole 332, and a second wire hole 333. The at least one opening 331 is formed through two lateral edges of the second rear lid 33. The at least one third pin hole 332 is formed in a lower portion of an inner surface of the second rear lid 33. When the second front lid 32 joins the second rear lid 33, the at least one projection 321 of the second front lid 32 engages the at least one opening 331 of the second rear lid 33 and the at least one third pin 322 of the second front lid 32 is inserted into the at least one third pin hole 332 of the second rear lid 33, such that the second front lid 32 can be assembled on the first rear lid 22 with the battery 31 mounted inside the second body 30. The second wire hole 333 is formed through the second rear lid 33. A wire tube 334 is mounted between the first body 20 and the second body 30 and penetrates through the first wire hole 223 of the first body 20 and the second wire hole 333 of the second body 30. The battery 31 is a lithium battery and has a power wire 311. The power wire 311 is connected with the battery 31 and is mounted inside the wire tube 334 to electrically connect and supply power to the circuit board 28. After the USB port 284 of the first body 20 is connected to an external power source, the external power source charges the battery 31 through the circuit board 28 and the power wire 311.

Figure 4:
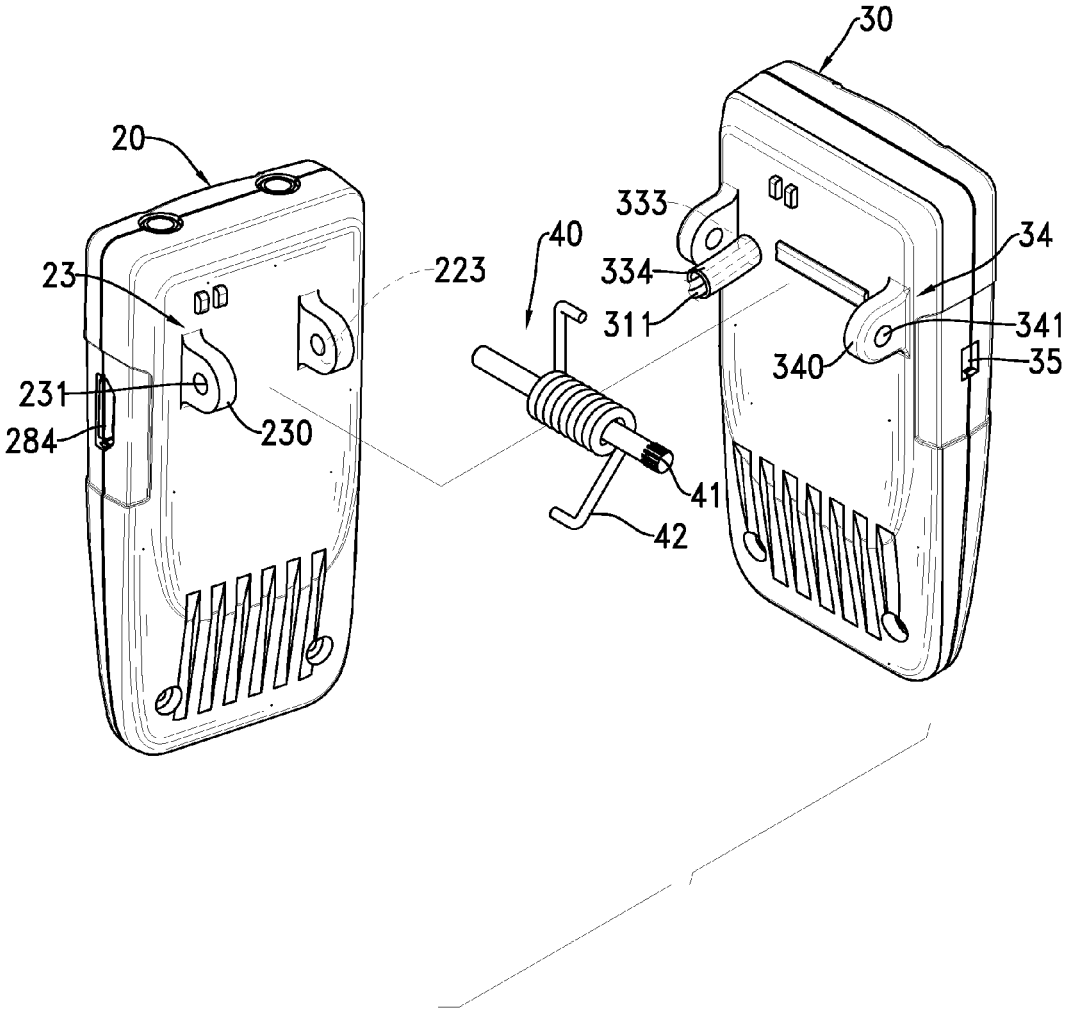
FIG. 4 is a partially exploded perspective view of the first body and the second body of the clip-on transceiver microphone in FIG. 1.
Figure 5:
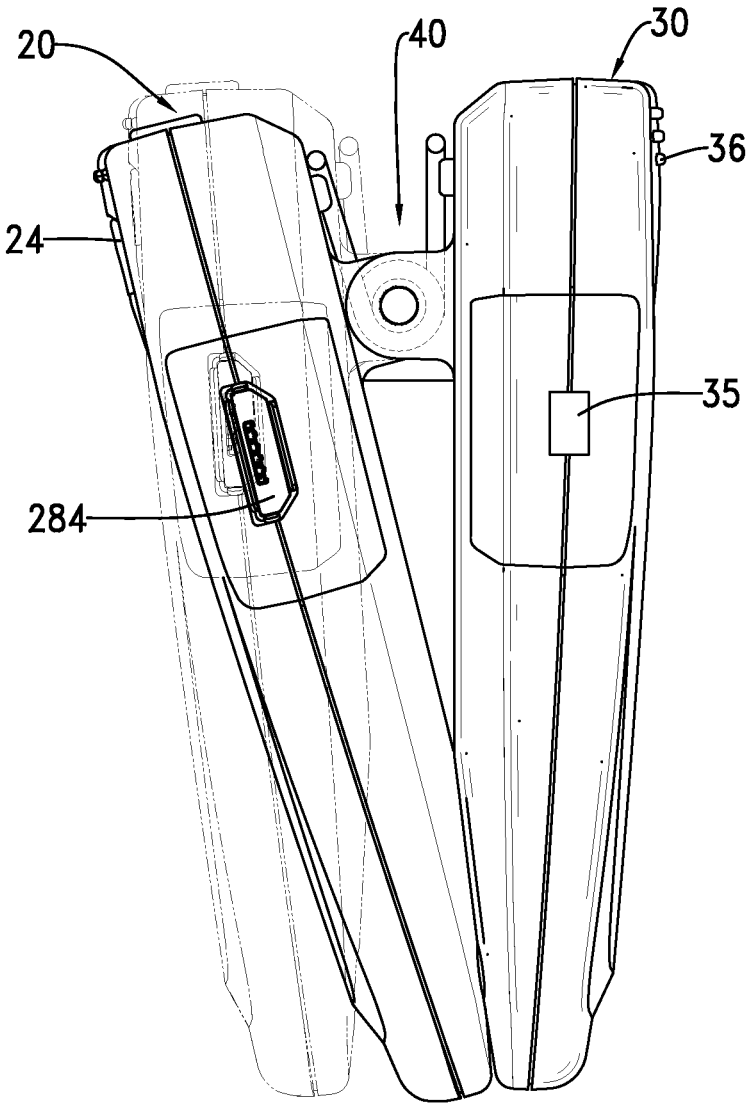
FIG. 5 is an operational side view of the clip-on transceiver microphone in FIG. 1.

With reference to FIGS. 4 and 5, the first body 20 further has a first shaft bracket 23 with two first lugs 230 parallelly formed on and protruding inwards from a top portion of an inner surface of the first body 20. Each first lug 230 has a first shaft hole 231 formed through the first lug 230. The second body 30 further has a second shaft bracket 34 with two second lugs 340 parallelly formed on and protruding inwards from a top portion of an inner surface of the second body 30. Each second lug 340 has a second shaft hole 341 formed through the second lug 340. The pivot shaft assembly 40 includes a pivot spindle 41 and a torsion spring 42. The pivot spindle 41 is pivotally mounted through the first shaft holes 231 of the first shaft bracket 23 and the second shaft holes 341 of the second shaft bracket 34 for the first shaft bracket 23 and the second shaft bracket 34 to be pivotable with respect to the pivot spindle 41. The torsion spring 42 is mounted around the pivot spindle 41 with two spring arms respectively abutting against the inner surfaces of the first body 20 and the second body 30.

The first body 20 has a first force exertion portion 24 on a top portion of an outer surface of the first body 20 that is opposite to the portion of the inner surface of the first body 20 with the first shaft bracket 23, and the second body 30 has a second force exertion portion 36 on a top portion of an outer surface of the second body 30 that is opposite to the portion of the inner surface of the second body 30 with the second shaft bracket 34. When two fingers respectively squeeze the first force exertion portion 24 and the second force exertion portion 36 at the same time, the two spring arms of the torsion spring 42 approach each other and the torsion spring 42 is in a twisted state, such that a bottom portion of the inner surface of the first body 20 and a bottom portion of the inner surface of the second body 30 that are initially tightly tied to each other are open and the clip-on transceiver microphone 10 can be clipped on an object, such as a collar or a tie, after the fingers are removed and the tension of the torsion spring 42 is released.

Figure 6:
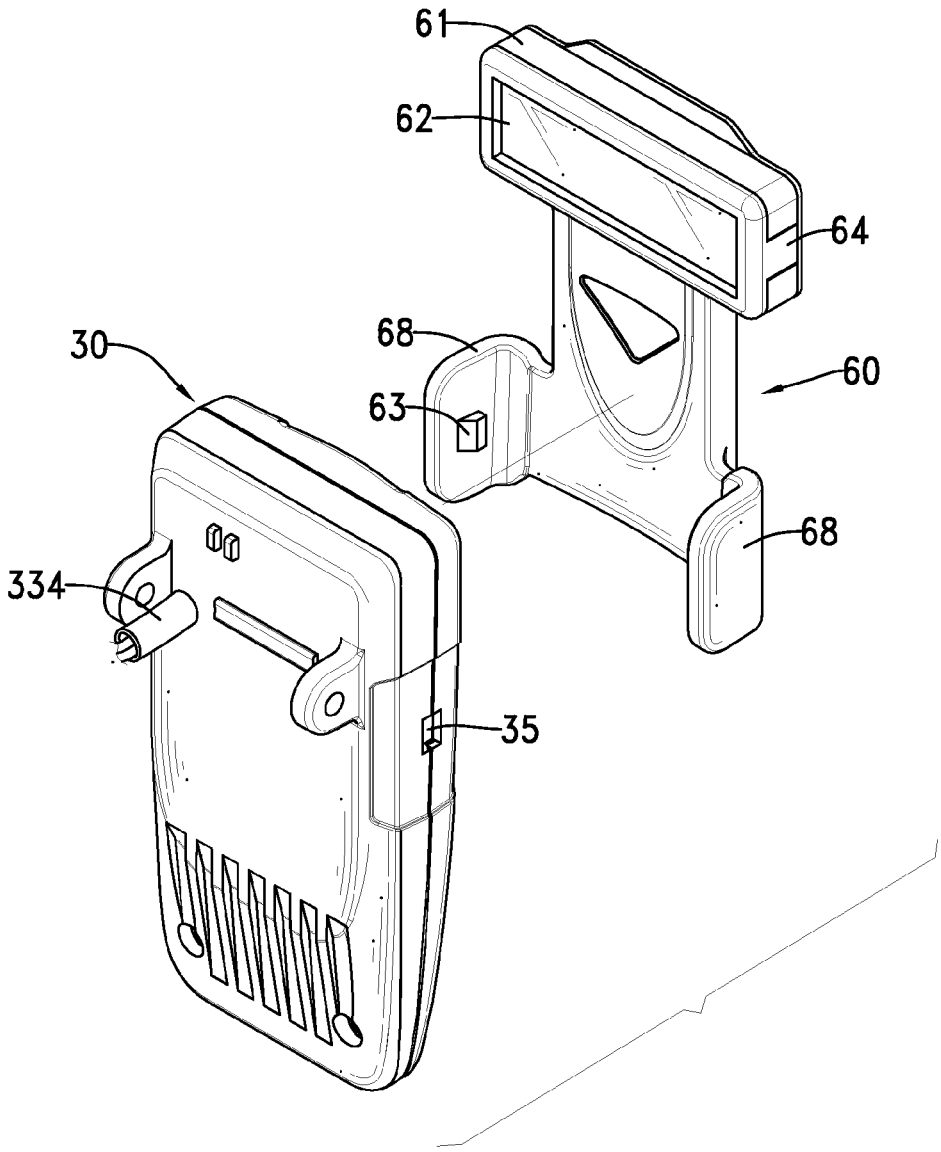
FIG. 6 is a partially exploded perspective view of the second body in FIG. 1 with a detached name holder.

With reference to FIG. 6, the second body 30 further has two catching slots 35 respectively formed in two lateral portions thereof for mounting a name holder 60 on the second body 30. The name holder 60 has a name frame 61, two side legs 68, and two insertion blocks 63. The name frame 61 is formed on a top portion of the name holder 60 for receiving a name card 62. The two side legs 68 are parallelly formed on and protrude from two opposite edges of a lower portion of the name holder 60. Each insertion block 63 is formed on and protrudes inwards from an inner wall of one of the two side legs 68 to correspond to one of the catching slots 35. The name holder 60 is made of an elastic material. The two side legs 68 can be slightly bent outwards for the two insertion blocks 63 to engage the respective two catching slots 35 on the second body 30, thereby fastening the name holder 60 on the second body 30. The name frame 61 has a cover 64 detachably mounted thereon. Users can detach the cover 64 from the name frame 61 to replace the name card 62 inside the name frame 61.

Figure 7:
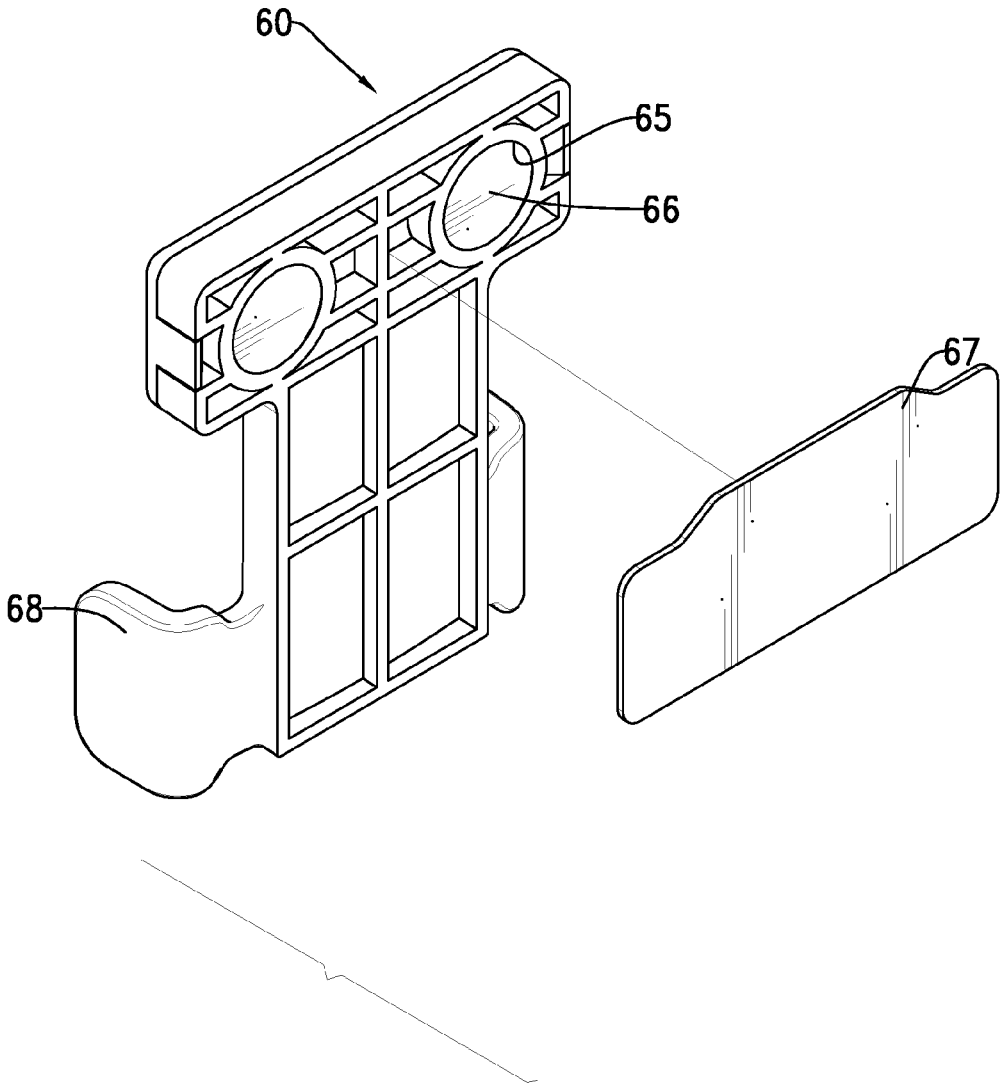
FIG. 7 is an exploded perspective view of the name holder in FIG. 6.

With reference to FIG. 7, the name holder 60 further has a cavity 65, at least one magnet 66, and a metal plate 67. The cavity 65 is formed in the name holder 60. The at least one magnet 66 is mounted inside the cavity 65. The metal plate 67 is magnetically attached to the at least one magnet 66. The metal plate 67 can be removed from the at least one magnet 66 by pulling the metal plate 67 with a force. A portion of clothes can be sandwiched between the metal plate 67 and the at least one magnet 66, thereby providing another way of clipping the clip-on transceiver microphone 10 on users.

Figure 8:
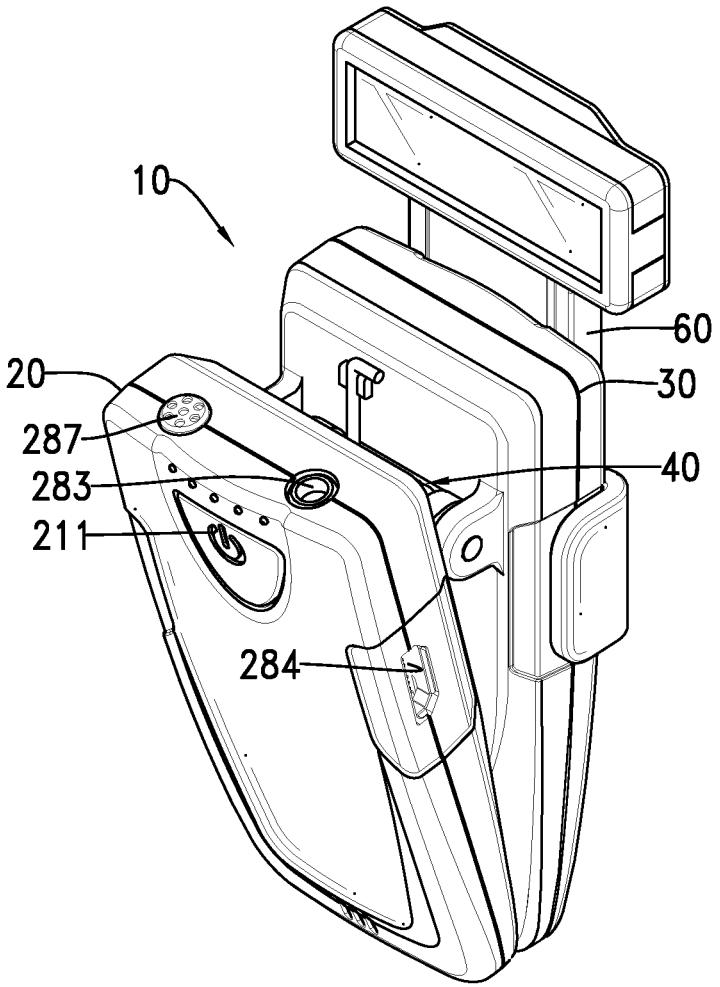
FIG. 8 is a perspective view of a second embodiment of a clip-on transceiver microphone in accordance with the present invention.
Figure 9:
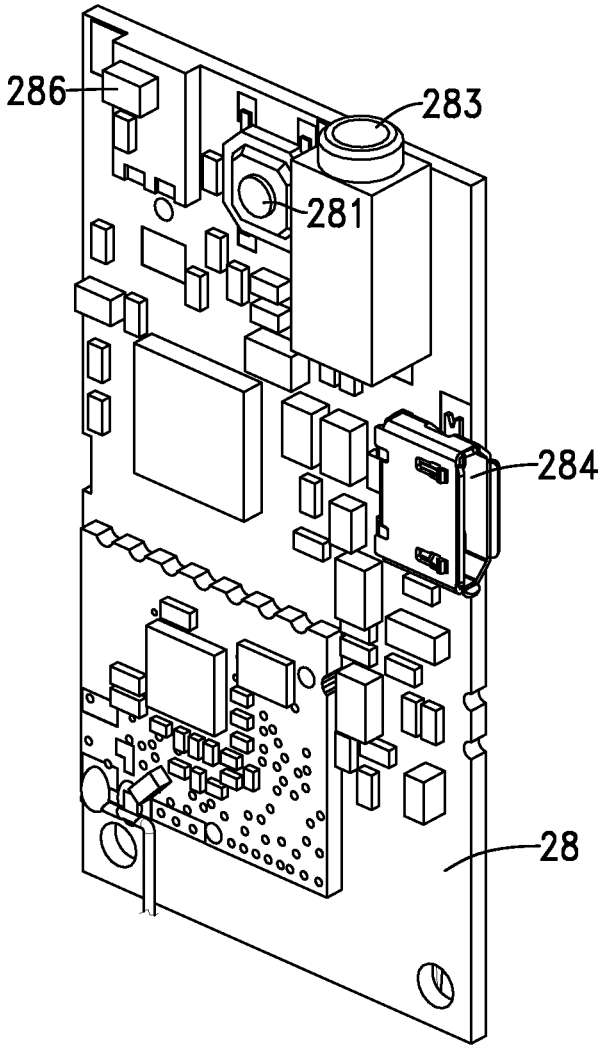
FIG. 9 is a perspective view of a circuit board of the clip-on transceiver microphone in FIG. 8.

With reference to FIGS. 8 and 9, a second embodiment of a clip-on transceiver microphone in accordance with the present invention differs from the foregoing embodiment in that the first body 20 has a sound-receiving port and a mouth piece 287. The sound-receiving port is mounted on the first body 20. The mouth piece 287 is mounted on the sound-receiving port for receiving users' voice. The circuit board 28 further has a microphone 286 mounted thereon and corresponding to the sound-receiving port of the first body 20. In other words, the clip-on transceiver microphone 10 has an embedded microphone capable of directly receiving sound from the embedded microphone 286 on the circuit board 28.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A clip-on transceiver microphone, comprising:

a first body having:

a circuit board;

a microphone jack formed on the first body and electrically connected to the circuit board;

a first shaft bracket formed on an inner surface of the first body; and a first force exertion portion located on a top portion of an outer surface of the first body opposite to a portion of the inner surface of the first body with the first shaft bracket;

a second body having:

a battery mounted inside the second body with a power wire electrically connected to the circuit board in the first body to supply power to the circuit board;

a second shaft bracket formed on an inner surface of the second body; and a second force exertion portion located on a top portion of an outer surface of the second body opposite to a portion of the inner surface of the second body with the second shaft bracket; and a pivot shaft assembly pivotally mounted through the first shaft bracket and the second shaft bracket with a bottom portion of the inner surface of the first body abutting against a bottom portion of the inner surface of the second body after the pivot shaft assembly is assembled with the first body and the second body.

2. The clip-on transceiver microphone as claimed in claim 1, wherein the pivot shaft assembly has a pivot spindle and a spring, the first shaft bracket has two first lugs parallelly formed on and protruding inwards from the inner surface of the first body and each first lug has a through hole formed through the first lug, the second shaft bracket has two second lugs parallelly formed on and protruding inwards from the inner surface of the second body and each second lug has a through hole formed through the second lug, and the pivot spindle is pivotally mounted through the first lugs of the first shaft bracket and the second lugs of the second shaft bracket and the spring is mounted around the pivot spindle.

3. The clip-on transceiver microphone as claimed in claim 2, wherein the spring is a torsion spring with two spring arms respectively abutting against the inner surfaces of the first body and the second body.

4. The clip-on transceiver microphone as claimed in claim 3, wherein the first body includes:

a first front lid having:

at least one projection formed around and protruding inwards from an inner perimetric edge of the first front lid; and at least one first pin formed on and protruding inwards from a lower portion of an inner surface of the first front lid;

a first rear lid having:

at least one opening formed through two lateral edges of the first rear lid; and at least one first pin hole formed in a lower portion of an inner surface of the first rear lid;

wherein when the first front lid joins the first rear lid, the at least one projection of the first front lid engages the at least one opening of the first rear lid and the at least one first pin of the first front lid is inserted into the at least one first pin hole of the first rear lid to form a complete first body; and the second body includes:

a second front lid having:

at least one projection formed around and protruding inwards from an inner perimetric edge of the second front lid; and at least one third pin formed on and protruding inwards from a lower portion of an inner surface of the second front lid; and a second rear lid having:

at least one opening formed through two lateral edges of the second rear lid; and at least one third pin hole formed in a lower portion of an inner surface of the second rear lid;

wherein when the second front lid joins the second rear lid, the at least one projection of the second front lid engages the at least one opening of the second rear lid and the at least one third pin of the second front lid is inserted into the at least one third pin hole of the second rear lid to form a complete second body with the battery mounted between the second front lid and the second rear lid.

5. The clip-on transceiver microphone as claimed in claim 4, wherein the first rear lid of the first body further has at least one second pin formed on and protruding inwards from the inner surface of the first rear lid, the circuit board has at least one second pin hole formed through the circuit board, and the at least one second pin of the first rear lid is inserted into the at least one second pin hole of the circuit board for the circuit board to be fastened on the first rear lid.

6. The clip-on transceiver microphone as claimed in claim 1, further comprising a name holder mounted on the second body, wherein the name holder has:

a name frame formed on a top portion of the name holder for receiving a name card; and two side legs parallelly formed on and protruding from two opposite edges of a lower portion of the name holder.

7. The clip-on transceiver microphone as claimed in claim 5, further comprising a name holder mounted on the second body, wherein the name holder has:

a name frame formed on a top portion of the name holder for receiving a name card; and two side legs parallelly formed on and protruding from two opposite edges of a lower portion of the name holder.

8. The clip-on transceiver microphone as claimed in claim 6, wherein the name holder further has:

a cavity formed in the name holder;

at least one magnet mounted inside the cavity; and a metal plate magnetically attached to the at least one magnet and being removable from the at least one magnet by pulling the metal plate with a force.

9. The clip-on transceiver microphone as claimed in claim 7, wherein the name holder further has:

a cavity formed in the name holder;

at least one magnet mounted inside the cavity; and a metal plate magnetically attached to the at least one magnet and being removable from the at least one magnet by pulling the metal plate with a force.

10. The clip-on transceiver microphone as claimed in claim 6, wherein the second body further has two catching slots respectively formed in two lateral portions of the second body; and the name holder further has two insertion blocks, wherein each insertion block is formed on and protrudes inwards from an inner wall of one of the two side legs to correspond to and engage one of the catching slots.

11. The clip-on transceiver microphone as claimed in claim 7, wherein the second body further has two catching slots respectively formed in two lateral portions of the second body; and the name holder further has two insertion blocks, wherein each insertion block is formed on and protrudes inwards from an inner wall of one of the two side legs to correspond to and engage one of the catching slots.

12. The clip-on transceiver microphone as claimed in claim 10, wherein the name frame of the name holder has a cover detachably mounted on the name frame to be detached for replacing the name card inside the name frame.

13. The clip-on transceiver microphone as claimed in claim 11, wherein the name frame of the name holder has a cover detachably mounted on the name frame to be detached for replacing the name card inside the name frame.

14. The clip-on transceiver microphone as claimed in claim 1, wherein the first body has a sound-receiving port mounted on the first body, and the circuit board has a microphone mounted thereon and corresponding to the sound-receiving port of the first body.

15. The clip-on transceiver microphone as claimed in claim 5, wherein the first body has a sound-receiving port mounted on the first body, and the circuit board has a microphone mounted thereon and corresponding to the sound-receiving port of the first body.

* * * * *